US011976906B2

(12) United States Patent
McWilliam et al.

(10) Patent No.: US 11,976,906 B2
(45) Date of Patent: May 7, 2024

(54) BULLET STABILIZATION IN SUBSONIC FLIGHT

(71) Applicant: Jamie George McWilliam, Hamilton, MT (US)

(72) Inventors: Jamie George McWilliam, Hamilton, MT (US); Charles Edmond McWilliam, Sr., Boulder City, NV (US)

(73) Assignees: Jamie George McWilliam, Hamilton, MT (US); Charles Edmond McWilliam, Boulder City, NV (US)

( * ) Notice: Subject to any disclaimer, the term of this patent is extended or adjusted under 35 U.S.C. 154(b) by 0 days.

(21) Appl. No.: 18/097,520

(22) Filed: Jan. 17, 2023

(65) Prior Publication Data

US 2023/0384068 A1 Nov. 30, 2023

Related U.S. Application Data

(62) Division of application No. 17/590,885, filed on Feb. 2, 2022, now abandoned.

(Continued)

(51) Int. Cl.
*F42B 12/74* (2006.01)
*F42B 5/02* (2006.01)

(Continued)

(52) U.S. Cl.
CPC ..... *F42B 10/10* (2013.01); *F42B 5/02* (2013.01); *F42B 5/067* (2013.01); *F42B 10/24* (2013.01);

(Continued)

(58) Field of Classification Search
CPC .... F42B 5/00; F42B 5/02; F42B 5/067; F42B 5/073; F42B 5/26; F42B 5/28;

(Continued)

(56) References Cited

U.S. PATENT DOCUMENTS 807,012 A * 12/1905 Bell ..... F42B 12/78 102/514
819,518 A * 5/1906 Clark ..... F42B 5/02 102/511

(Continued)

FOREIGN PATENT DOCUMENTS

DE 261392 C * 10/1912
DE 1199661 B * 8/1965

(Continued)

OTHER PUBLICATIONS

Machine Translation of Schnepff. DE 261392 C. Google Patents. Oct. 1912. (Year: 1912).*

*Primary Examiner* — Gabriel J. Klein
(74) *Attorney, Agent, or Firm* — Jamie G. McWilliam

(57) ABSTRACT

The present invention relates to increasing the flight stability of a bullet in subsonic flight. The bullet may incorporate features that impart additional angular momentum during flight. Helical fins may be configured such that laminar airflow over the bullet during flight increases rotational forces, thus increasing the angular momentum of the bullet and stabilizing it during flight. The fins may be self-forming during the use of the bullet or may be formed during manufacturing.

18 Claims, 9 Drawing Sheets

Related U.S. Application Data

(60) Provisional application No. 63/165,226, filed on Mar. 24, 2021.

(51) Int. Cl.

| | |
|---|---|
| ***F42B 5/067*** | (2006.01) |
| ***F42B 10/10*** | (2006.01) |
| ***F42B 10/24*** | (2006.01) |
| ***F42B 10/26*** | (2006.01) |
| ***F42B 12/78*** | (2006.01) |
| ***F42B 14/00*** | (2006.01) |

(52) U.S. Cl.
CPC ..... *F42B 10/26* (2013.01); *F42B 12/74* (2013.01); *F42B 12/78* (2013.01); *F42B 14/00* (2013.01)

(58) Field of Classification Search
CPC ..... F42B 5/285; F42B 10/10; F42B 10/22; F42B 10/24; F42B 10/26; F42B 12/78; F42B 7/10; F42B 33/001
See application file for complete search history.

(56) References Cited

U.S. PATENT DOCUMENTS 1,012,455 A * 12/1911 Scott ..... F42B 12/78 102/514
1,072,880 A * 9/1913 Tewes ..... F42B 12/78 102/501
1,777,519 A * 10/1930 Flowers ..... F42B 5/02 42/78
RE18,252 E * 11/1931 Alden ..... F42B 5/02 102/439
2,089,219 A * 8/1937 Moore ..... F42B 10/10 42/78
2,414,863 A * 1/1947 Foster ..... F42B 7/10 102/517
3,003,420 A * 10/1961 Nosler ..... F42B 12/34 102/508
4,176,487 A * 12/1979 Manis ..... F41A 21/00 42/76.01
2002/0078852 A1* 6/2002 Beal ..... F42B 12/745 102/516
2011/0290141 A1* 12/2011 Engel ..... F42B 5/16 102/439
2011/0290142 A1* 12/2011 Luchini ..... F42B 30/02 102/524
2015/0285604 A1* 10/2015 Bosarge ..... F42B 33/0207 86/31
2017/0131071 A1* 5/2017 Burkart ..... F42B 10/38

FOREIGN PATENT DOCUMENTS

WO WO-9937971 A1 * 7/1999 ..... F42B 12/34
WO WO-2010077213 A1 * 7/2010 ..... F42B 10/24

* cited by examiner

BULLET STABILIZATION IN SUBSONIC FLIGHT

CROSS REFERENCE TO RELATED APPLICATIONS

This application is a divisional of U.S. application Ser. No. 17/590,885, filed Feb. 2, 2022, entitled "BULLET STABILIZATION IN SUBSONIC FLIGHT", which claims priority to U.S. Provisional Application No. 63/165,226, filed Mar. 24, 2021, both of which are hereby incorporated by reference in their entirety.

BACKGROUND

Bullets in subsonic flight struggle with tumbling and other issues that affect their accuracy. By employing certain measures that impart additional angular momentum to the bullet during flight, flight stability may be maintained during the entire flight of the bullet.

SUMMARY

Some embodiments relate to a bullet having features that stabilize it during subsonic flight. The bullet includes a nose section, a cylindrical midsection, a cylindrical tail section, and a concave base. The cylindrical tail section has a diameter greater than or equal to the diameter of the cylindrical midsection. Further, the surface of the cylindrical tail section has a material hardness that is less than or equal to the material hardness of the surface of the cylindrical midsection. The material hardness of the surface of the cylindrical tail section is such that the cylindrical tail section is capable of being mechanically formed to include fins.

In some embodiments, the surface of the cylindrical midsection is one of copper or lead. In some embodiments, the surface of the cylindrical tail section is one of aluminum and lead. In some embodiments, the bullet also includes at least one core material, where the core material(s) is one of tungsten, steel, copper, or lead.

Some embodiments relate to a bullet having features that stabilize it during subsonic flight, such as a parabolic nose, a cylindrical midsection, a secant ogive tail, and at least one helical fin protruding from the tail section. The radius of the helical fin(s) is less than or equal to the radius of the cylindrical midsection.

In some embodiments, the bullet has at least one jacket material, where the jacket material(s) is one of copper or lead. In some embodiments, the bullet has at least one core material, where the core material(s) is one of tungsten, steel, copper, or lead.

Some embodiments relate to a method of stabilizing a bullet in subsonic flight. The method includes firing a bullet that includes a nose section, a cylindrical midsection, and a cylindrical tail section capable of forming fins. The method further includes forming fins in the cylindrical tail section. The fins are configured to impart angular momentum onto the bullet via the airflow over the fins during flight. The method further includes imparting angular momentum to the bullet via the airflow over the fins during flight.

In some embodiments, the fins are formed by the rifling of the barrel through which the bullet is fired. In some embodiments, the fins are formed by at least one blade inside the casing in which the bullet is loaded. In some embodiments, the fins are formed during manufacturing of the bullet.

DETAILED DESCRIPTION

Most commercially available bullets are designed for supersonic flight speeds. As such, when they are fired at subsonic speeds, they may tumble during flight or exhibit other undesirable aerodynamic characteristics. Such problems are typically mitigated by the gyroscopic effect of the angular momentum imparted to the bullet by the rifling of the barrel it is fired through. However, the drag of the air over the bullet can cause a loss of this angular momentum, causing the bullet to lose flight stability.

A solution to this problem may involve the use of helical fins on the bullet. During subsonic flight, the laminar air flow may pass over the bullet, and across the radial surface of the fins. As the air flows over the fins, the fluid flow will apply a force to the fins due to the fins' twist rate. A portion of the force aligned with the linear velocity vector of the bullet may act to slow the bullet. A portion of the force orthogonal to the linear velocity vector of the bullet may apply a moment to the bullet, causing it to maintain its spin. Thus it may cause the bullet to maintain its angular momentum over its entire flight. This in turn may help alleviate some of the problems inherent in subsonic ballistics, such as, but not limited to, tumbling in flight, loss of impact energy, and the changes in both accuracy and precision of the firearm shots fired at subsonic speeds.

In some embodiments, the fins may be formed during the manufacturing of the bullet, and be rigidly affixed to the bullet. Conversely, in some embodiments the fins may be self-forming. In such an embodiment, the fins may be formed by the rifling of the barrel through which the bullet is fired, through a carving mechanism in the casing, or through any other forming means that will activate at some point after the manufacturing of the bullet.

Figure 1A:
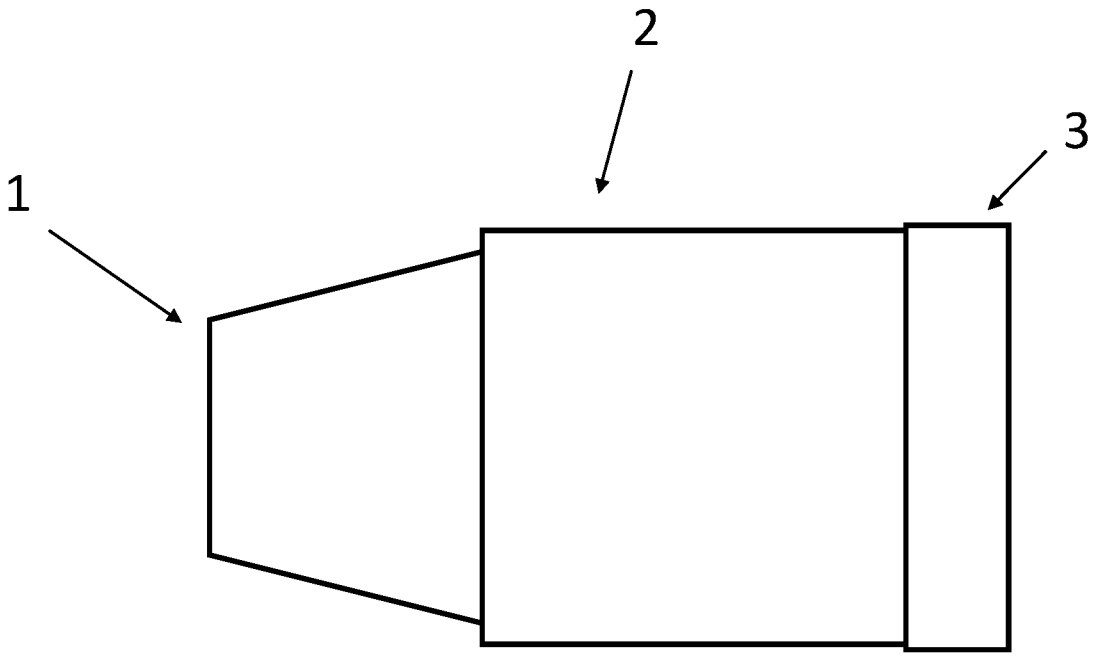
FIG. 1*a* is a representation of a bullet with a soft tail section material capable of forming fins.
Figure 1B:
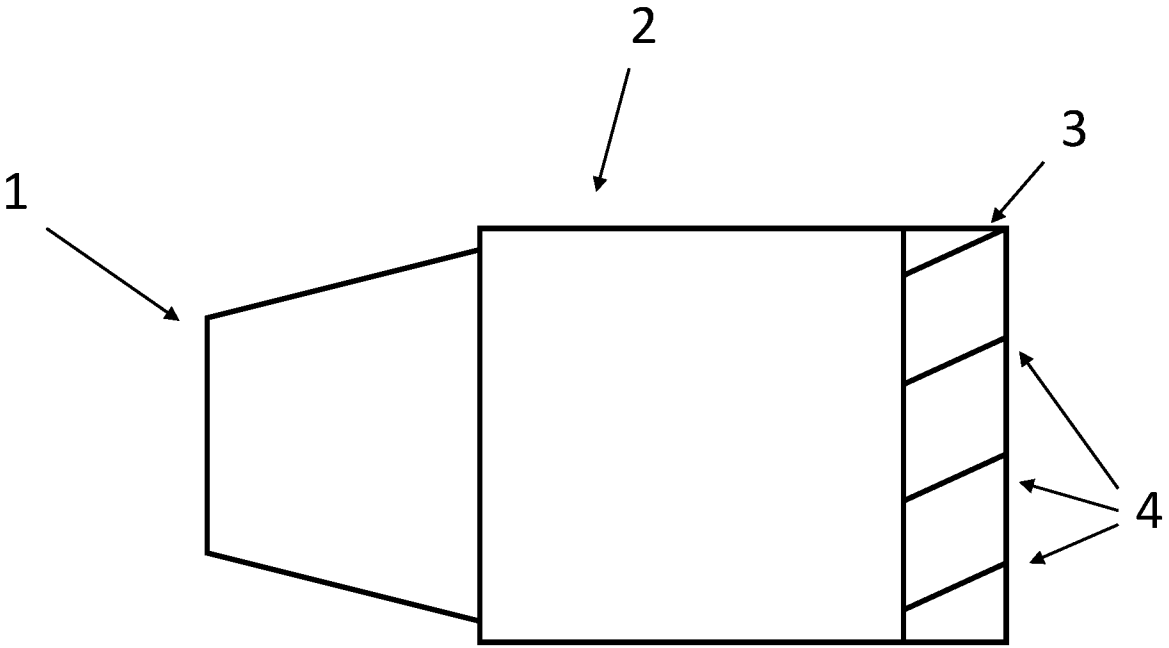
FIG. 1B is a representation of a bullet with a soft tail section material capable of forming fins after fins have been formed.

Referring to FIGS. 1*a* and 1*b*, in one embodiment, a bullet having self-forming fins may have a nose section 1, a cylindrical midsection 2, and a cylindrical tail section 3. The nose section 1 is preferably parabolic, but may be hemispherical, a truncated cone, or any other appropriate geometry. The surface of the tail section 3 may be of a material having a material hardness less than the surface of the midsection 2. Alternatively, the tail section 3 may be constructed of the same material as the midsection 2, as long as the tail section does not have a material hardness greater than that of midsection. Further, the tail section 3 may have a diameter greater than or equal to the diameter of the midsection 2.

In an embodiment having a tail section 3 that is softer and wider than the midsection 2, the fins may be formed as follows. When the bullet is fired, the bullet enters the barrel, and engages with the barrel rifling. When the tail section reaches the rifling, the extended diameter causes the tail section to fill the rifling more completely than the midsection. As the bullet travels down the barrel, the portion of the tail section filling the rifling will protrude, while the rest of the surface will be formed to the internal diameter of the barrel. This will cause helical fins 4 to be formed into the tail section of the bullet. Using a tail section of a softer material than the midsection enhances this forming effect, allowing the rifling to cut fins into the tail section while having little effect on the harder surface of the midsection.

In an embodiment as described above, the tail section material may be a part of the core of the bullet. The nose and midsection may be formed from a jacket of a material having a higher material hardness than that of the core and/or tail section. For example, the bullet may be manufactured with a copper jacket over a lead core. The core may then be formed such that the tail section contains a lip that extends beyond the diameter of the copper jacket. Other materials for the jacket and core are anticipated, and this disclosure is not so limited.

Once formed, the helical fins may have a larger impact on the flight stability of a bullet in subsonic flight than on one in supersonic flight. This is because subsonic flight is characterized by laminar flow. Thus the air travels smoothly over the length of the bullet, fully engaging with the fins, and imparting angular momentum to the bullet. Conversely, the air does not flow smoothly over a mach wave, and thus at supersonic speeds the air will not fully engage with the fins.

Figure 2A:
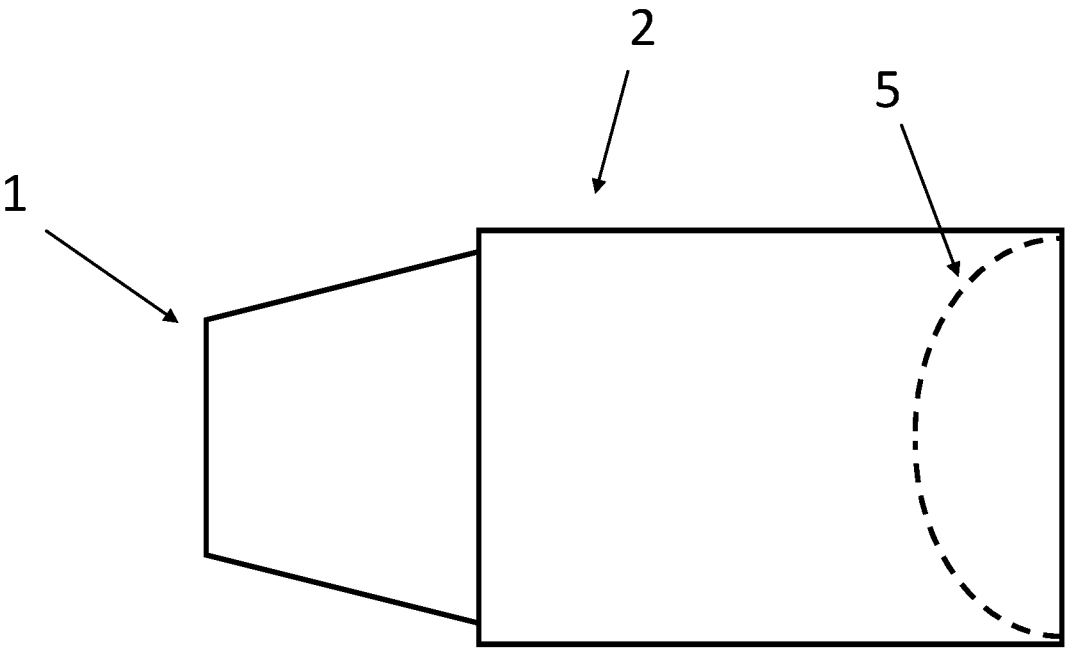
FIG. 2*a* is a representation of a bullet with a concave base capable of forming fins.
Figure 2B:
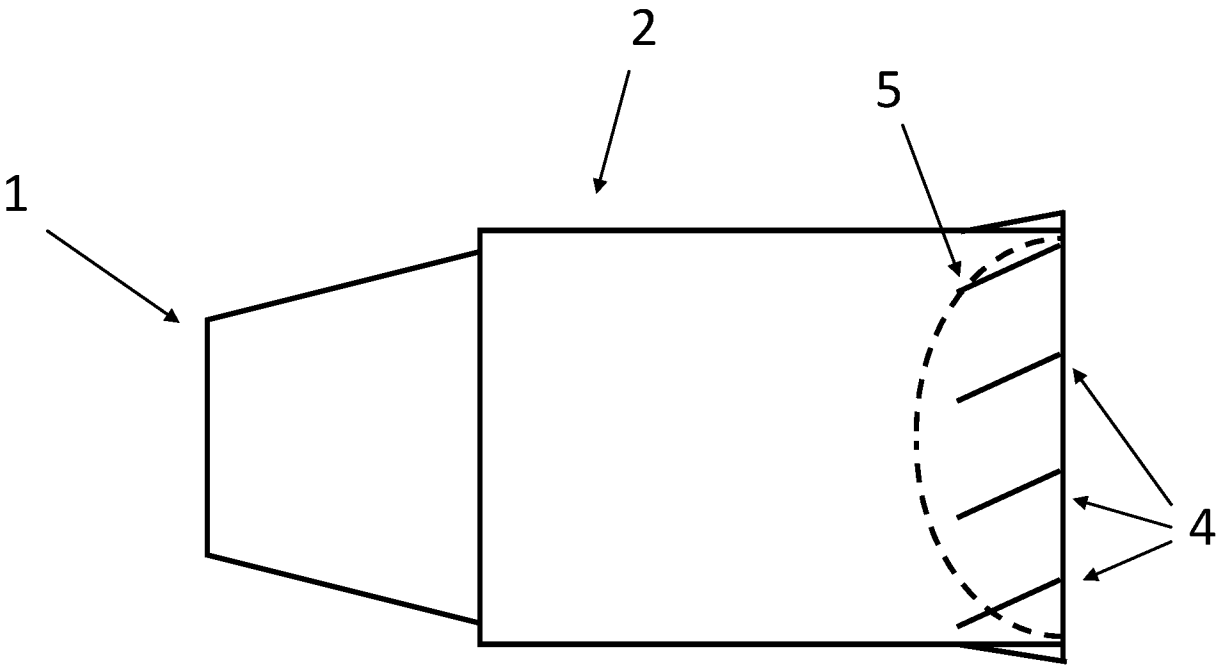
FIG. 2*b* is a representation of a bullet with a concave base capable of forming fins after fins have been formed.

Referring to FIGS. 2*a* and 2*b*, in another embodiment, a bullet having self-forming fins may have a nose 1, a cylindrical midsection 2, and concave base 5. In this embodiment, the fins may be formed as follows. When the bullet is fired, the expanding gas fills the concave base 5, applying pressure radially against the wall of the concave portion. The portion of the pressure that aligns with the direction of the barrel causes the bullet to travel down the barrel. The portion of the pressure on the thinner side walls of the concave base attempts to expand the side walls. Once the bullet enters the barrel, this pressure expands the side walls into the barrel rifling, forming fins 4 with a twist equal to that of the rifling.

In an embodiment described above, the bullet may be made of a solid material, or be made of a jacketed core, or be constructed in any other manner common to the art. If the bullet has a jacket and core, then the jacket may extend rearwards towards the tail of the bullet beyond the core. For example, if the bullet has a copper jacket over a lead core, then the core may stop at the depth of the concavity, with sidewalls formed of the copper jacket. In this case, the fins 4 will be formed from the expanded copper. Other materials and constructions may be used, and this disclosure is not so limited.

FIGS. 2*a* and 2*b* illustrate a relatively hemispherical concavity. However, other shapes, such as paraboloids, cylinders, or other geometries, are anticipated, and this disclosure is not so limited.

Figure 3:
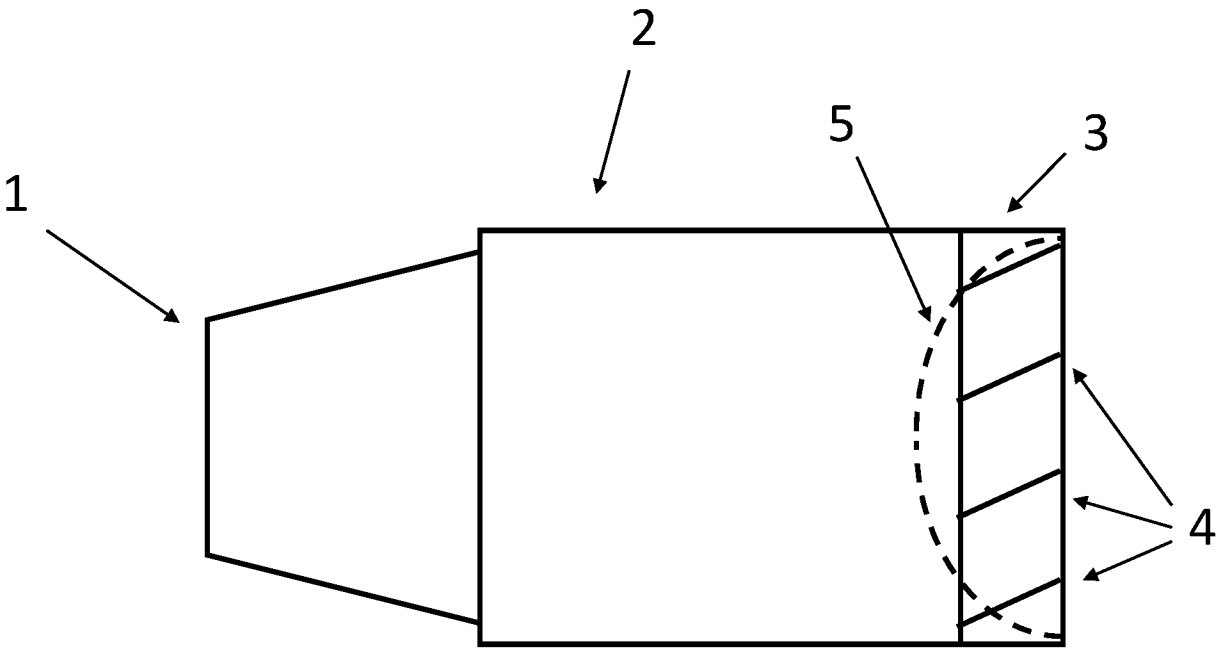
FIG. 3 is a representation of a bullet with a concave base and a soft tail section material capable of forming fins after fins have been formed.

Referring to FIG. 3, in another embodiment, a bullet having self-forming fins may have a nose section 1, a cylindrical midsection 2, a cylindrical tail section 3, and a concave base 5. The surface of the tail section 3 may be of a material having a material hardness less than the surface of the midsection 2. Alternatively, the tail section 3 may be constructed of the same material as the midsection 2, as long as the tail section does not have a material hardness greater than that of midsection. Further, the tail section 3 may have a diameter greater than or equal to the diameter of the midsection 2.

In such an embodiment, the fins are formed through a combination of the effects described above. When the bullet is fired, the expanding gas in the chamber presses the thin sidewalls of the concavity 5 into the rifling, causing the material to fill the rifling more completely than that of the midsection 2, or than that of a typical bullet. Using a softer material and/or larger diameter for the tail section 3 enhances this effect, providing for more efficient fin 4 formation.

Figure 4:
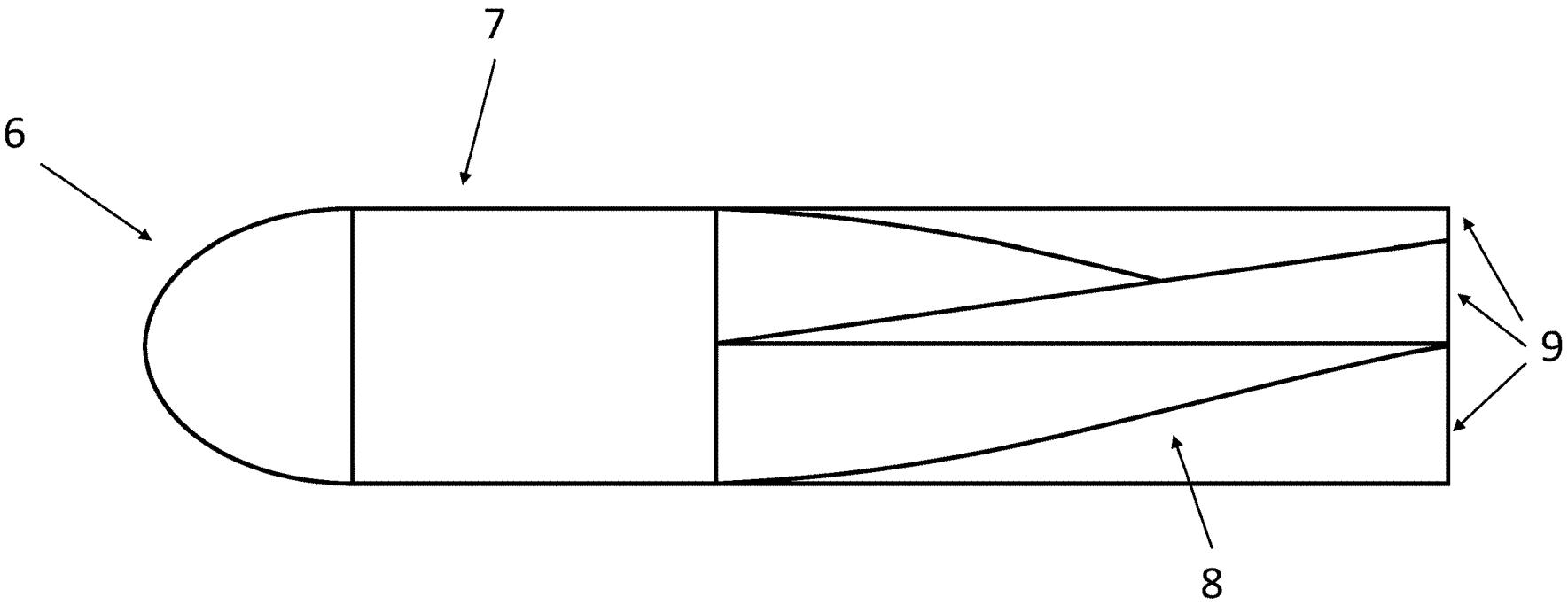
FIG. 4 is a representation of a bullet with a parabolic nose, cylindrical midsection, a secant ogive tail section, and a number of helical fins protruding from the tail section.

Referring to FIG. 4, in another embodiment, a bullet may have a nose section 6, a cylindrical midsection 7, a secant ogive tail section 8, and helical fins 9. The nose section 6 is preferably parabolic, but may be hemispherical, a truncated cone, or any other appropriate geometry. This nose geometry, combined with the secant ogive tail section 8 provides for more stable laminar flow over the length of the bullet. This, in turn, enhances the effectiveness of the helical fins 9.

The fins 9 may extend the full length of the tail section, or for any portion thereof. They may extend out to the diameter of the midsection 7, or any fraction thereof. The twist of the fins 9 would preferably be timed to the twist of the rifling of the gun in which the bullet is to be used.

The design of this embodiment enhances the flight stability of a bullet at subsonic speed as follows. When the bullet is fired, the rifling of the barrel imparts angular momentum to the bullet, helping it to not tumble during flight. Once the bullet clears the end of the barrel and reaches clean air, the streamline of the airflow will pass smoothly over the nose 6, the midsection 7, and upon reaching the tail section 8 will follow the narrowing curve of the tail. This will provide a large surface of air for the fins 9 to engage with. As the air flows over the fins 9, the fluid flow will apply a force to the fins due to the fins' twist rate. A portion of the force aligned with the linear velocity vector of the bullet will act to slow the bullet. A portion of the force orthogonal to the linear velocity vector of the bullet will apply a moment to the bullet, causing it to maintain its spin. Thus it causes the bullet to maintain its angular momentum over its entire flight. This in turn helps alleviate some of the problems inherent in subsonic ballistics, such as, but not limited to, tumbling in flight, loss of impact energy, and the changes in both accuracy and precision of the firearm shots fired at subsonic speeds.

Figure 5:
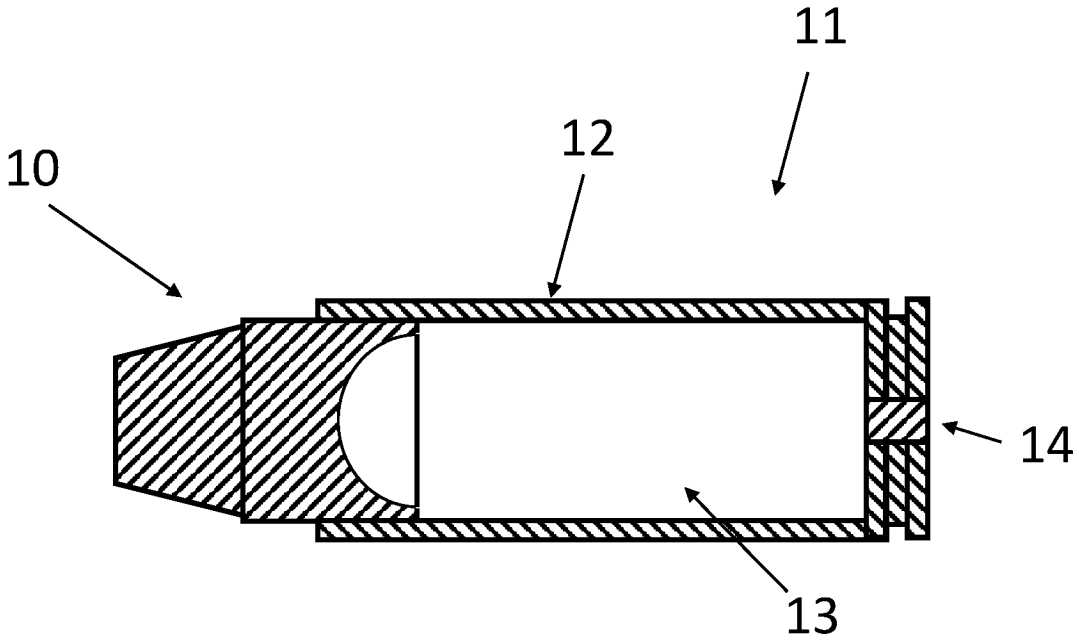
FIG. 5 is a cross-section of a bullet with a concave base capable of forming fins assembled with a casing, propellant, and primer.

Referring to FIG. 5, in an embodiment, a bullet 10 as described above may be used with a suitable casing 11. While a straight casing 11 is illustrated, any suitable casing may be used, such as a necked down casing. The casing may be characterized by a sidewall 12 that defines an interior chamber 13 for holding a propellant. In some embodiments, the propellant may be smokeless powder, although other propellants may be used and this embodiment is not so limited. The casing 11 may include a primer pocket in the base for receiving a primer 14. The ignition end of the primer 14 may be positioned such that, upon striking by the firing pin of a firearm, the flame from the primer 14 may ignite the propellant within the interior chamber 13. A bullet 10, such as any of the novel designs described in this application, may be seated in the casing 11, whereby it may be held in place at least partially by friction. While the bullet 10 is illustrated to have a concave base, any suitable bullet, such as those of FIG. 1, 2, 3, or 4, or any other suitable bullet, may be used and this disclosure is not so limited.

Figure 6:
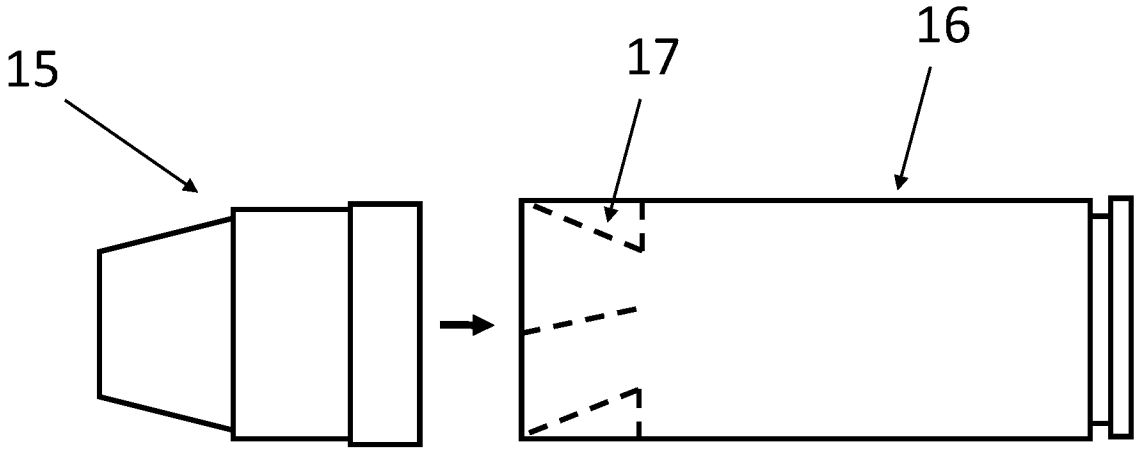
FIG. 6 is a representation of a bullet with a soft tail section material capable of forming fins being pressed into a casing with a number of cutting features capable of cutting fins into the tail section of the bullet.

In another embodiment, a bullet with a self-forming stabilizing means may have such means formed in a way other than by the barrel rifling. For example, referring to FIG. 6, a bullet may be received in a casing 16 having at least one internal cutting blade 17. When the bullet is pressed into the casing 16, the internal blades 17 may cut into the material of the tail section of the bullet 15, forming helical grooves in the tail section. Upon firing the bullet 15, these grooves may help to stabilize the bullet in the same manner as the fins described above. For example, the bullet 15 may be made using a copper jacket over a lead core. The lead core may form the tail section of the bullet 15, such that the surface of the tail section is lead. By pressing the bullet 15 into the casing 16 during loading, the internal blades 17 press into the softer material of the lead, forming helical grooves. These grooves provide the same functionality as the fins described above, and may be viewed to form wide fins between the grooves. While the bullet 15 is illustrated to have such a construction, any suitable bullet, such as those of FIG. 1, 2, 3, or 4, or any other suitable bullet, may be used and this disclosure is not so limited. Further, while a straight casing 16 is illustrated, any suitable casing may be used, such as a necked down casing.

The internal blades 17 may be formed through a variety of means, and be of a variety of geometries and dimensions. The internal blades 17 may be attached to the inside of the casing 16. Alternatively, they may be made from the material of the sidewall of the casing 16. In such a situation, they may be pressed, crimped inwards, or formed through any other suitable means. The internal blades 17 may be narrow and sharp, as in a knife blade, such that they cut the material of the bullet 15. Alternatively, they may be wider, such that they press the material of the bullet inwards. In such a case, they may be much wider than the gaps between them, whereby they form fins similar to those illustrated in FIGS. 1*b*, 2*b*, 3, and 4. So, while narrow, triangular blades 17 are illustrated, internal blades 17 having any of the geometries described, or any other suitable geometry, may also be utilized, and this disclosure is not so limited.

Figure 7:
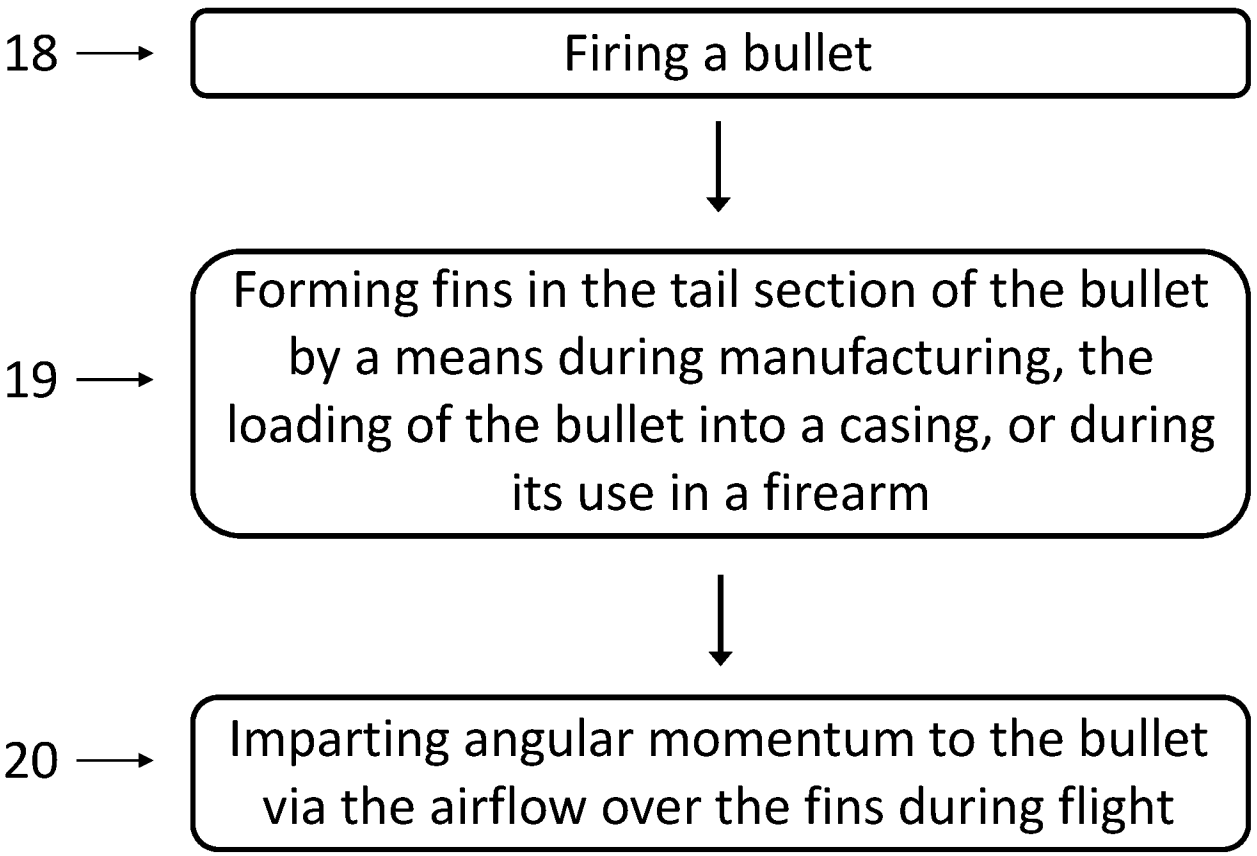
FIG. 7 is a diagram of a method of stabilizing a bullet in subsonic flight.

Referring to FIG. 7, a method of stabilizing a bullet in subsonic flight is provided. In step one 18, a bullet may be fired through a means known to the art. In step two 19, fins may be formed in the tail section of the bullet. Such fins may be formed after firing the bullet, either by the rifling of the barrel, or by another means. One skilled in the art could also readily envision how step two 19 could be performed before step one 18. In such a case, the fins may be formed when the bullet is pressed into a casing, such as in the embodiment of FIG. 6, or they may be formed through other suitable means wherein they are formed before firing the bullet but after manufacturing of the bullet. Alternatively, the fins may be formed during manufacturing of the bullet, such as in the embodiment of FIG. 4. Once the fins are formed and the bullet is in flight, in step three 20, the airflow over the fins may impart angular momentum to the bullet.

Because angular momentum is directional, conservation of momentum makes it difficult not only to change the amount of angular momentum in a system, but also its direction. In the present invention, this means that once angular momentum is imparted to the bullet in step three 20, it becomes much more difficult to change the orientation of the bullet during flight. This helps protect against tumbling, and subsequently loss of impact energy, and the changes in both accuracy and precision of the firearm shots fired at subsonic speeds.

The invention here described of novel aerodynamics and construction has been shown to alleviate the problems inherent in subsonic ballistics, such as, but not limited to, tumbling in flight, loss of impact energy, as well as the changes in both accuracy and precision of the firearm shots fired at subsonic speeds. It is understood that the foregoing examples are merely illustrative of the present invention. Certain modifications of the articles and/or methods may be made and still achieve the objectives of the invention. Such modifications are contemplated as within the scope of the claimed invention.

The invention claimed is:

1. An ammunition cartridge optimized for subsonic applications, comprising:
- a bullet having a nose section, a cylindrical midsection, a cylindrical tail section, and a concave base;
- a propellant;
- a primer;
- a bullet casing having an open end for receiving the propellant and the bullet, at least one internal blade, and a base with a primer pocket for receiving the primer;
- wherein the at least one internal blade is a triangular blade having a knife edge;
- wherein the at least one internal blade is formed from a sidewall of the bullet casing by a method selected from the group consisting of pressing the sidewall inward and crimping the sidewall inward;
- wherein the cylindrical midsection has a first diameter and a first surface comprising a first material having a first material hardness;
- wherein the cylindrical tail section has a tail length, a second diameter, and a second surface comprising a second material having a second material hardness;
- wherein the second diameter is greater than or equal to the first diameter;
- wherein the second material hardness is less than the first material hardness;
- wherein the at least one internal blade and the second material hardness are configured to form at least one helical fin on the cylindrical tail section, but not on the nose section or on the cylindrical midsection, during loading of the bullet into the bullet casing; and
- wherein the at least one helical fin is configured to impart angular momentum on the bullet during flight.

2. The ammunition cartridge of claim 1, wherein the concave base has a base depth greater than or equal to the tail length.

3. The ammunition cartridge of claim 2, wherein the concave base is further configured to apply radial pressure against the at least one internal blade by the cylindrical tail section when the bullet is fired.

4. The ammunition cartridge of claim 3, wherein the first material is selected from the group consisting of copper and lead.

5. The ammunition cartridge of claim 4, wherein the second material is selected from the group consisting of aluminum and lead.

6. The ammunition cartridge of claim 5, wherein the bullet further comprises at least one core having at least one core material.

7. The ammunition cartridge of claim 6, wherein the bullet further comprises a jacket, wherein the jacket comprises the nose section and cylindrical midsection, and wherein the jacket is configured to receive the at least one core.

8. The ammunition cartridge of claim 7, wherein the at least one core comprises the cylindrical tail section and concave base.

9. The ammunition cartridge of claim 6, wherein the at least one core material is selected from the group consisting of tungsten, steel, copper, aluminum, and lead.

10. An ammunition cartridge optimized for subsonic applications, comprising:

a bullet having a nose section, a cylindrical midsection, a cylindrical tail section, and a concave base;

a propellant;

a primer;

a bullet casing having an open end for receiving the propellant and the bullet, at least one internal blade, and a base with a primer pocket for receiving the primer;

wherein the at least one internal blade is a triangular blade having a knife edge;

wherein the at least one internal blade is attached to an inner face of a sidewall of the bullet casing by a method selected from the group consisting of molding the at least one internal blade into the inner face, fastening the at least one internal blade to the inner face, welding the at least one internal blade to the inner face, and soldering the at least one internal blade to the inner face;

wherein the cylindrical midsection has a first diameter and a first surface comprising a first material having a first material hardness;

wherein the cylindrical tail section has a tail length, a second diameter, and a second surface comprising a second material having a second material hardness;

wherein the second diameter is greater than or equal to the first diameter;

wherein the second material hardness is less than the first material hardness;

wherein the second material hardness is configured to form at least one helical fin on the cylindrical tail section, but not on the nose section or on the cylindrical midsection, during loading of the bullet into the bullet casing; and wherein the at least one helical fin is configured to impart angular momentum on the bullet during flight.

11. The ammunition cartridge of claim 10, wherein the concave base has a base depth greater than or equal to the tail length.

12. The ammunition cartridge of claim 11, wherein the concave base is further configured to apply radial pressure against a rifling of a gun barrel by the cylindrical tail section when the bullet is fired.

13. The ammunition cartridge of claim 12, wherein the first material is selected from the group consisting of copper and lead.

14. The ammunition cartridge of claim 13, wherein the second material is selected from the group consisting of aluminum and lead.

15. The ammunition cartridge of claim 14, wherein the bullet further comprises at least one core having at least one core material.

16. The ammunition cartridge of claim 15, wherein the bullet further comprises a jacket, wherein the jacket comprises the nose section and cylindrical midsection, and wherein the jacket is configured to receive the at least one core.

17. The ammunition cartridge of claim 16, wherein the at least one core comprises the cylindrical tail section and concave base.

18. The ammunition cartridge of claim 15, wherein the at least one core material is selected from the group consisting of tungsten, steel, copper, aluminum, and lead.

* * * * *